United States Patent [19]

Graafsma

[11] 4,014,515

[45] Mar. 29, 1977

[54] SNUBBER FOR ONE END LIFT JACKS

[75] Inventor: Richard S. Graafsma, Benton Harbor, Mich.

[73] Assignee: Auto Specialties Manufacturing Company, St. Joseph, Mich.

[22] Filed: Nov. 24, 1975

[21] Appl. No.: 634,923

[52] U.S. Cl. ..... 254/2 B; 254/93 R

[51] Int. Cl.[2] ..... B66F 3/24

[58] Field of Search ..... 254/2 B, 93 R; 92/8, 92/9

[56] References Cited

UNITED STATES PATENTS

| | | | |
|---|---|---|---|
| 2,645,485 | 7/1955 | Mead | 92/9 |
| 2,679,827 | 6/1954 | Perdue | 92/8 |
| 2,973,184 | 2/1961 | Trautman et al. | 254/2 B |
| 3,081,743 | 3/1963 | Bishop et al. | 92/9 |
| 3,158,208 | 11/1964 | Kammerer | 254/93 R |
| 3,315,571 | 4/1967 | Mott et al. | 92/8 |
| 3,929,057 | 12/1975 | Kondo | 92/9 |

*Primary Examiner*—Al Lawrence Smith
*Assistant Examiner*—Robert C. Watson
*Attorney, Agent, or Firm*—Olson, Trexler, Wolters, Bushnell & Fosse, Ltd.

[57] ABSTRACT

A one end lift or like jack is provided with a snubber which prevents a lift saddle from rising in an uncontrolled manner. The snubber comprises a bi-ended cylinder closed at both ends which is affixed to the lift cylinder for corresponding vertical motion. A piston rod is affixed to a relatively stationary lift frame, and a piston is mounted to the rod within the snubber cylinder to define two cylinder chambers. Within the piston is an axial bleed port bore permitting fluid to bleed between the chambers. A check ring can be moved by fluid pressure imbalance along the snubber piston rod into a closed position against the bleed port, inhibiting fluid flow and prohibiting uncontrolled rise of the snubber and main cylinders. When the check ring is not in its closed position, relatively free lift lowering action is permitted.

13 Claims, 5 Drawing Figures

29
26
28
30
52
23
32
22
33
5
5
53
60
10

38
44
21
36
51
37
13
45
11

60
26
47
46
48
21
49
44
45
51

SNUBBER FOR ONE END LIFT JACKS

BACKGROUND OF THE INVENTION

This invention relates generally to motion dampers or snubbers for lifts, jacks or like lifting devices.

Jacks or lifting devices known as one end lifts have met with wide commercial acceptance in auto repair garages, truck maintenance facilities, and similar shops. These lifts are favored because the lift user can relatively easily elevate an entire end of a vehicle or like load, providing extensive access to the vehicle underside. The lifts can be moved about from one job to another, and are not as expensive as less versatile hoists or other devices which are sometimes installed in a shop floor for raising an entire vehicle.

In use, hydraulic or pneumatic pressure raises a lift saddle which engages one end of a vehicle and elevates the vehicle end to a work height. However, if the vehicle or other lifted load should shift or fall off a pneumatic lift, that pressure exerted by the compressed air which was used to lift both the saddle and the load may be applied against only the lifting saddle alone, resulting in a very rapid saddle rising action. Rapid saddle rise is undesirable from a safety standpoint, for it can result in damage to the load, bystandstanders, or the lift itself.

While mechanisms have been offered to prevent or inhibit this sudden saddle rise, it is also necessary that, under normal lift use conditions, relatively prompt, positive saddle up and down motion be available to raise and lower the load in a normally expeditious manner.

It is therefore the general object of the present invention to provide apparatus for an improved one end lift which keeps the lift saddle and associated lifting parts from suddenly rising should the load be lost, yet which permits positive lift saddle up and down motion under normal, controlled conditions.

It is another object of the invention to provide a damping action to sudden lift part extension or saddle rise, but to interject only a minimum damping action under normal lift lowering conditions.

It is another object to provide a lift snubber mechanism which accomplishes these tasks, yet which is relatively easy to service when necessary. A related object is to provide such a snubber which can be removed and replaced or adjusted for proper action with a minimum of service effort and expense.

Another object is to provide a lift snubber which is relatively straightforward in design and inexpensive to manufacture, yet which is reliable and rugged in use.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention.

Figure 1:
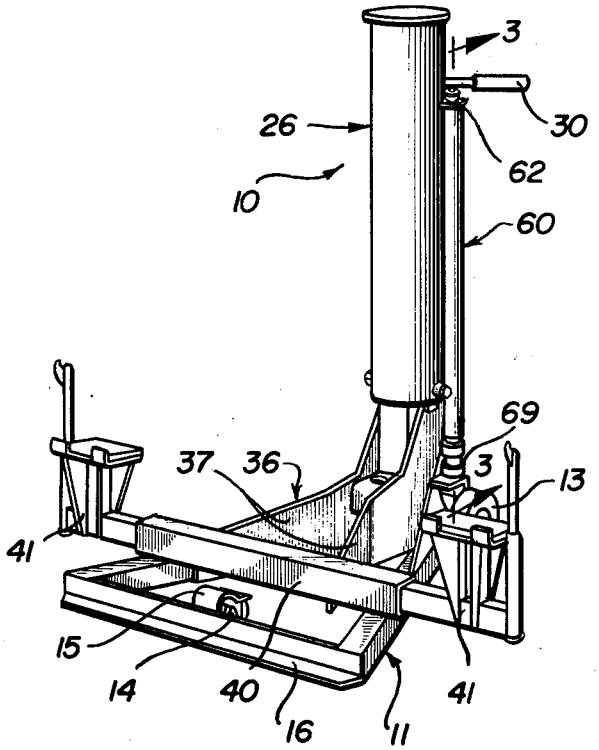
FIG. 1 is a perspective view showing a one end lift including the snubber of the present invention.
Figure 3:
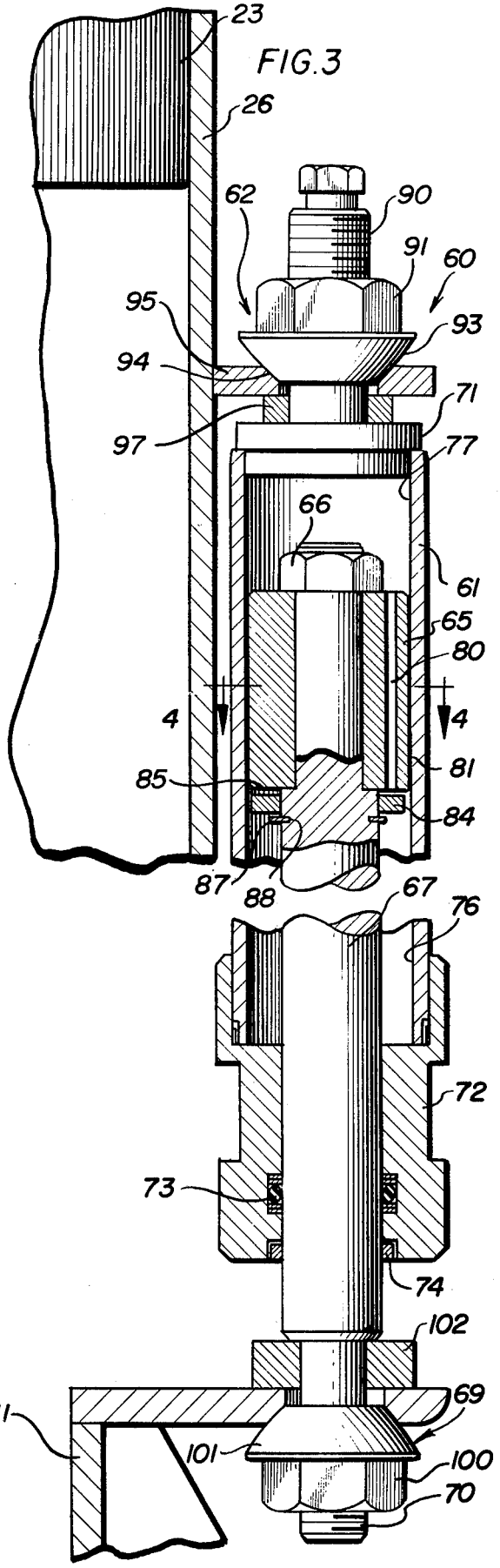
FIG. 3 is a fragmentary sectional view taken substantially in the plane of line 3—3 in FIG. 1.
Figure 4:
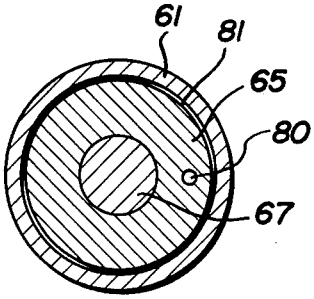
FIG. 4 is a sectional view taken substantially in the plane of line 4—4 in FIG. 3.
Figures 2, 5:
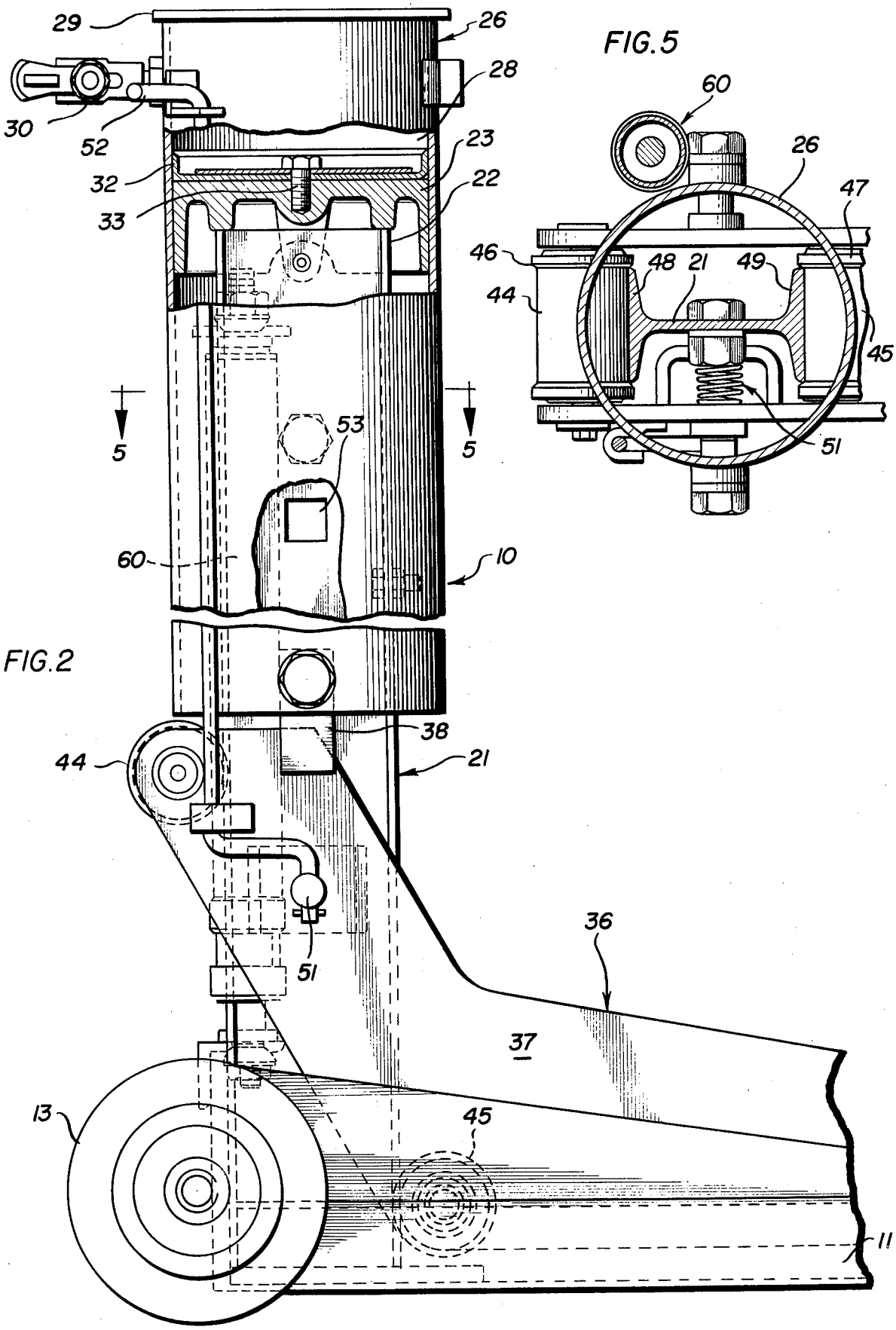
FIG. 2 is a fragmentary elevational view of the lift showing its general construction in further detail.
FIG. 5 is a sectional view taken substantially in the plane of line 5—5 in FIG. 2.

Turning first to FIGS. 1, 2 and 5, there is shown a one end lift 10 which includes the present invention. This lift 10 includes a generally triangular frame 11 adapted for firm supportive contact with a shop floor or other ground support. Rear wheels 13 and a front caster 14 are mounted to the frame and allow the lift to be rolled from place to place within the shop. When a load is engaged, a caster mounting 15 permits a front frame plate 16 to be depressed firmly into floor-engaging position.

From the frame 11 rises an upright column or piston rod 21 which here takes the form of an I-beam. At an upper column end 22, a piston 23 is fixed, and over the column 21 and piston 23 a cylinder 26 is telescoped for vertically reciprocable motion. When compressed air or the like is admitted to or withdrawn from a chamber 28 defined between the piston 23 and cylinder top end 29, (as by a valve 30) the cylinder 26 rises or falls correspondingly. In the illustrated embodiment, a seal wiper 32 is attached by a screw nut 33 to the piston 23 to prohibit leakage and assure proper lift operation.

Attached to the cylinder 26 for vertically upward and downward motion therewith is a saddle assembly 36, which here takes the form of two outwardly extending arms 37 attached, as by lift links 38, to the cylinder 26. These arms 37 terminate in a cross brace 40 provided with lift pads 41 and associated structure which can be slid in and out of the cross brace 40 to accommodate loads of various sizes and shapes. Frictional resistance to vertical motion of the saddle 40 is lessened by guide rollers 44 and 45, as may be especially seen in FIG. 5. These guide rollers 44 and 45 each terminate in radially extended flanges 46 and 47 respectively which center and guide the rollers 44 and 45 on flanges 48 and 49 constituting portions of the upright I-beam column or rod 21. A locking mechanism 51, which can be remotely operated by a latch handle 52, prevents accidental downward saddle motion or slippage by engagement with appropriate apertures 53 here formed in the upright column 21.

Should a load accidentally fall off the saddle lift pad mechanism 41, uncontrolled saddle rise is prohibited in accordance with the invention. To this end, a snubber cylinder arrangement 60 includes a snubber cylinder 61 affixed by an attachment 62 to the main lift cylinder 26. Slidably mounted within the cylinder 61 is a snubber piston 65 which is affixed, by a nut 66 or other convenient means, to a piston rod 67. Appropriate structure 69 attaches a free end 70 of this piston rod 67 to a suitable portion of the lift fixed frame 11. Thus, as can be envisioned, the snubber cylinder 61 slides up and down over the relatively stationary snubber piston 65 and portions of the snubber piston rod 67 simultaneously with motion of the main cylinder 26 over the relatively stationary main piston 23 and its supportive column 21.

The snubber cylinder 61 is closed at its head end by a cylinder head 71, and at its rod end by an annular rod end cap 72. Appropriate O-rings 73 and a wiper 74 may be affixed within this rod end cap 72 to retain hydraulic liquid or other fluid within a rod end chamber 76 defined by the piston 65, the piston end cap 72 and the cylinder 61 itself. A head end chamber 77 is correspondingly formed between the cylinder head 71, the piston 65 and the cylinder 61 itself.

To provide the desired snubbing or damping action as the main cylinder 26 and attached snubber cylinder 61 rise rapidly, fluid within the rod end chamber 76 is drawn into the snubber head chamber 77. At least some of this fluid flow occurs through a bleed port 80 formed in an axial direction within the piston 65 itself. Piston manufacture is made easy and bleed port clogging is discouraged by forming but one bore 80 of a diameter sufficiently large to permit bleeding action at a rate to accommodate normal lift operation. If desired, additional bores can be provided in the piston without departing from the spirit of the invention in its general aspect. The piston 65 and cylinder 61 are sized to provide a relatively loose fit, so that fluid can also bleed from the rod end chamber 76 to the head chamber 77 through an annular space 81 defined between the piston 65 and cylinder 61 itself.

It will be understood that, so long as rising motion of the main cylinder 26 is relatively moderate in its speed, and occurs in a normal operating manner, relatively moderate pressure imbalances between the two chambers 76 and 77 will be generated and relatively moderate bleeding action will occur.

However, to prevent rapid or uncontrolled rising action of the main cylinder 26 in accordance with the invention, rapid rising action of the attached snubber cylinder 61 is prevented. When relatively rapid rising action of the cylinder 61 is attempted, relatively great pressure imbalances are correspondingly generated between the rod end chamber 76 and head end chamber 77. When this occurs, an annular ring 84, carried around the piston rod 67 is slid axially along the rod into abuttive contact with the bottom surface 85 of the piston 65 by these pressure imbalances. This abuttive ring-piston contact effectively covers or closes the bleed port 80, entrapping fluid within the chamber 77 and preventing rapid, uncontrolled lift rising action. Again depending upon the size of the annular space 81 between the piston 65 and cylinder 61, a controlled fluid flow is permitted, thus restricting the rate of rise of the cylinders 26 and 61 to a slower, controlled rate which prevents user injury and lift damage. To keep the annular check ring 84 in its operating position, a keeper ring 87 is affixed to the rod 67, as within an annular mating groove 88 at a distance from the piston sufficient to permit the check ring 84 to slide away from the bleed port 80, thereby opening the port and permitting relatively free fluid flow.

When the main cylinder 26 and the saddle assembly 36 are to be lowered, air or other gas in the main cylinder chamber 28 is exhausted. As lowering action begins, fluid pressure imbalances in the snubber chambers 76 and 77 will be created. However, as can be envisioned, these imbalances and the resulting fluid flow will force the check ring 84 into an open position relative to the bleed port 80 thereby permitting relatively unrestricted fluid flow and expeditious lift lowering action.

Those experienced in this art will understand that when the cylinder 61 is located in a down or fully telescoped position over a major portion of the piston rod 67, the aggregate volume of the two chambers 76 and 77 available for filling with hydraulic fluid will be less than the aggregate volume available in those two chambers 76 and 77 when the cylinder 61 has been drawn to an up position, and the rod 67 has been in effect extracted from within the cylinder. This may be better understood when it is realized that this aggregate volume change is due to the insertion and withdrawal of lengths of the piston rod 67 into and from the rod end chamber 76. That volume of space within the cylinder 61 filled by the piston rod cannot, of course, be filled by fluid. To accommodate these changes in aggregate chamber volume, it is contemplated that the chambers 76 and 77 will be filled substantially full of hydraulic fluid or other liquid when the rod 67 is relatively fully inserted into the cylinder 61. As rod withdrawal occurs, a small vacuum will be correspondingly created in the top of the head end chamber 77; after prolonged lift use, this vacuum may be occupied by air at a reduced pressure. This air simply provides a cushioning effect enhancing the snubbing action.

As explained above, an attachment 62 rigidly connects the cylinder 61 to the main cylinder 26. Here, this attachment is accomplished by providing the cylinder head 71 with an axially extending threaded finger 90 and mating adjustment nut 91. A conically shaped washer 93 is carried on the finger 90 and fits within a mating beveled recess 94 formed in a brace 95; the brace 95 is affixed, as by welding or other convenient means, to the main cylinder 26. Firm but resilient connection can be supplied by including a washer 97 formed of hard rubber between this brace 95 and the cylinder head 71.

Like structure 69 is provided at the other end of this snubber, where the cylinder rod end 70 is secured to the standard 11 by a nut 100 and conical washer 101. Again, resilient action can be provided by a washer 102 formed of hard rubber or the like. By unthreading these nuts 100 and 91, the snubber 60 can be removed for adjustment or repair.

I claim:

1. A lifting jack operated by a gas comprising: a headed cylinder member, a piston slidable in the cylinder to define a closed chamber between the cylinder head and piston, a piston rod member attached to the piston for relative slidable motion at least partly into and out of the cylinder, and a snubber, comprising, in combination, a headed snubber cylinder affixed relative to one of the cylinder and piston rod members, a snubber piston slidable in the snubber cylinder to define a first closed chamber between the cylinder head and piston, the snubber including a first, selective, bleed port having a piston defining bleed port means in fluid communication with the closed snubber chamber, a snubber piston rod affixed relative to the other of the piston rod and cylinder members, and selective one way fluid flow check means cooperable with the piston bleed port, whereby fluid flow in one direction through the piston bleed port means is relatively free, and rapid fluid flow in the opposite direction through the bleed port means is relatively inhibited.

2. A snubber according to claim 1 wherein said snubber cylinder is affixed to said lift cylinder for vertical reciprocating motion therewith, and said snubber piston rod is affixed relative to said lift piston rod so as to remain stationary relative thereto.

3. A snubber according to claim 1 wherein the bleed port means is sized to permit flow of a fluid through the bleed port means into and out of the snubber cylinder chamber.

4. A snubber according to claim 1 including a cylinder head affixed to the cylinder at its rod end and surrounding said rod to define a second chamber within said cylinder between said piston and said cylinder rod and head, said fluid flow occurring between said first and second cylinders.

5. A snubber according to claim 1 wherein said bleed port means is defined by a single bore extending in an axial direction through said piston.

6. A snubber according to claim 1 wherein said one way fluid flow check means includes an annular ring carried on said piston rod for axially slidable motion therealong toward and away from said piston and said piston bleed port means so as to cover and uncover said bleed port means, relatively free fluid flow through said bleed port means occurring when the bleed port is uncovered by the annular ring, and relatively restricted fluid bleed flow occurring when said annular ring covers said bleed port means.

7. A snubber according to claim 6 including an annular keeper ring affixed to said piston rod at a distance spaced axially along said piston rod from said piston sufficient to permit the annular check ring to slide away from said bleed port means so as to open said bleed port means and permit relatively free fluid flow therethrough.

8. A snubber according to claim 1 including a second, non-selective, bleed port means defined by an annular bypass space between the outer diameter of said snubber piston and the uniform inner diameter of said snubber cylinder, the uniform, unobstucted annular bypass space permitting non-selective fluid flow bleeding action into and out of said first chamber.

9. A snubber for a lift jack operated by a gas, and having a base and a vertically reciprocable saddle, comprising, in combination, a bi-ended cylinder of uniform inner diameter, closed at both ends, a piston rod slidably protruding through a cylinder rod end, a piston affixed to the piston rod for slidable motion within the cylinder, thereby defining first and second chambers of variable volume between the piston and the closed cylinder ends, and first, selective, bleed means wherein the piston defines bleed port means extending between said first and second chambers and permitting fluid flow therebetween, and selective one way fluid flow check means cooperable with the piston bleed port means, whereby fluid flow in one direction between said first and second chambers is relatively free and rapid fluid flow in the opposite direction between the chambers is relatively inhibited.

10. A snubber according to claim 9 wherein that chamber formed between the piston and the cylinder rod head end is a head end chamber, and that chamber defined between the piston and the cylinder rod end is a rod end chamber, and said one way fluid flow check means is arranged so as to restrict fluid flow from the rod end chamber to the head end chamber as the rod is withdrawn from the cylinder, fluid flow occurring relatively freely from the head end chamber to the rod end chamber as the rod is inserted into the cylinder.

11. A snubber according to claim 9 including a hydraulic fluid substantially filling both chambers when said piston rod is substantially fully inserted into said cylinder.

12. A snubber according to claim 9 wherein said bleed port means is defined at least partly by a single bore extending between said two chambers through said piston.

13. A snubber according to claim 9 including a second, non-selective, bleed port means defined by an annular bypass space between the outer diameter of said piston and the uniform inner diameter of said cylinder, the uniform, unobstructed annular bypass space permitting non-selective fluid flow bleeding action between said first and second chambers.

* * * * *